United States Patent [19]

Bruno

[11] 3,958,751

[45] May 25, 1976

[54] SLITTED PACKAGING APPARATUS

[76] Inventor: Edward C. Bruno, 1880 S. Monaco, Denver, Colo. 80222

[22] Filed: Oct. 17, 1974

[21] Appl. No.: 515,655

[52] U.S. Cl. ..... 229/87 F; 229/DIG. 3; 428/136

[51] Int. Cl.[2] ..... B65D 65/10

[58] Field of Search ..... 229/87 R, 87 F, DIG. 3, 229/54 R; 161/109, DIG. 6; 428/136

[56] References Cited

UNITED STATES PATENTS

| | | | |
|---|---|---|---|
| 3,550,842 | 12/1970 | Scholz | 229/87 F |
| 3,655,501 | 4/1972 | Tesch | 161/109 |

*Primary Examiner*—Stephen P. Garbe
*Attorney, Agent, or Firm*—Bruce G. Klaas

[57] ABSTRACT

A wrapper of plastic material for wrapping produce such as lettuce having a central expandable slit pattern with uniformly spaced rows of uniformly shaped and spaced slits of step shape comprising first and second elongated slit portions extending parallel to the longitudinal direction of the slit pattern and offset from one another both in the longitudinal and transverse directions of the slit pattern and a third short length slit portion extending transversely to the longitudinal direction of the slit pattern and interconnecting adjacent ends of the first and second elongated slit portions.

9 Claims, 9 Drawing Figures

SLITTED PACKAGING APPARATUS

BACKGROUND AND SUMMARY OF INVENTION

In general, the invention relates to packaging materials of the type made of relatively thin flexible plastic film or sheet material and, more particularly, to packaging wrappers made of one flat sheet of such material for wrapping about and enclosing articles to be packaged. The present invention is particularly adapted for packaging of produce which requires ventilation and involves a new form of expandable slit pattern usable in various kinds of packaging materials such as bags, boxes and covers as well as wrappers.

One use of a wrapper of the type of this invention is in connection with wrapping of lettuce as disclosed in my prior U.S. Pat. No. 3,762,629. An advantage of the present invention is that the shape of the slits and the location of the slits relative to one another enables expansion of the slitted portion of the wrap in a new manner providing greater expansion than with prior art slit patterns of the type illustrated in U.S. Pat. Nos. 3,040,968, 3,067,039, 3,069,067, 3,109,579, 3,245,606, 3,550,842, 3,603,369, 3,655,501 and 3,762,629. As a result, larger heads of lettuce may be more easily wrapped with smaller size wrapper sheets and, if desired, the size of the wrapper sheets may be reduced to achieve the same kind of wrapping results achieved with prior art slit patterns on larger size wrapper sheets. In addition, the shape of the slits and the location of the slits relative to one another provides for expansion between slits in a new manner increasing the amount of expansion and reducing the likelihood of tearing between the slits. As a result, thinner gauge plastic sheet may be utilized without encountering tear problems as might be encountered with prior art slit patterns. The foregoing advantages are of substantial importance since the cost of plastic sheet and film materials has greatly increased in recent times.

Another advantage of the present invention involves the size and configuration of the openings produced in the plastic sheet material when the slit pattern has been expanded. In the present invention, the openings are of generally polygonal shape in the fully expanded position of the slit pattern and are of relatively large size while providing adequate retention of the contents of the wrapper. The large size of the openings permits adequate ventilation of the contents of the wrapper and facilitates the application of moisture to the contents as by spray techniques. In addition, the slit pattern of the present invention provides a new appearance in the fully expanded condition which is more attractive than prior slit patterns in that it provies a crisp sparkling appearance. Furthermore, when the slit pattern of the present invention is fully expanded, interconnected ribbon portions of the wrapper between the slits tend to turn 90 relative to the surface of the contents rather than laying flat against the surface of the contents as in prior art slit patterns so that the interconnected ribbon portions of the wrapper between the slits extend generally transversely at right angles to the periphery of the contents wrapped in the wrapper. Thus, more of the surface of the contents is exposed and the generally transversely extending interconnected portions of the wrapper act as vanes to catch and trap moisture applied to the contents, create a glittering effect by reflection of light, and also act as cushions between adjacent similarly wrapped articles such as lettuce on display in a bin at a store.

Another advantage of the present invention is that the cushion effect created by the transversely extending interconnected ribbon portions also provides a pleasing "fresh produce feel" when lettuce is handled by a customer due to the unique slit arrangement produced from parallel rows of longitudinally and transversely aligned generally step-shaped slits. When the sheet is stretched around a generally spherical object, such as a head of lettuce, the ribbon portions defined between adjacent pairs of slits twist and turn on edge so that flexible easily deflected flange portions on some of the ribbon portions extend transversely outwardly from the wrapper in position for several of them to engage the hand of a customer when the wrapped lettuce is held by the customer.

Accordingly, it is an object of the present invention to provide a novel and improved slit pattern for produce wrappers and the like having improved expansion characteristics and providing large openings for ventilation and application of water to the contents as well as facilitating viewing and touching of an article or articles covered thereby.

Another objective of the invention is to provide a produce wrapper having a unique appearance and cushioning effect.

Still another objective is to provide a produce wrapper which, upon being stretched in a direction to open the generally step-shaped slits, will cause ribbon-like portions formed therebetween to twist and turn on edge so as to protrude transversely relative to the surface of the wrapper and the contents thereof.

An additional object is to provide a produce wrapper having a centrally located slit pattern adapted to produce a multitude of variously angled light reflecting surfaces when stretched in a direction to open said slits.

Further objects of the invention forming the subject matter hereof are to provide a produce wrap slit pattern that is versatile, easy to use, relatively strong, readily adaptable to various plastic sheet materials and one that is distinctive as well as decorative in appearance.

Other objects will be in part apparent and in part pointed out specifically hereinafter in connection with the description of the drawings that follows, and in which.

Figure 1:
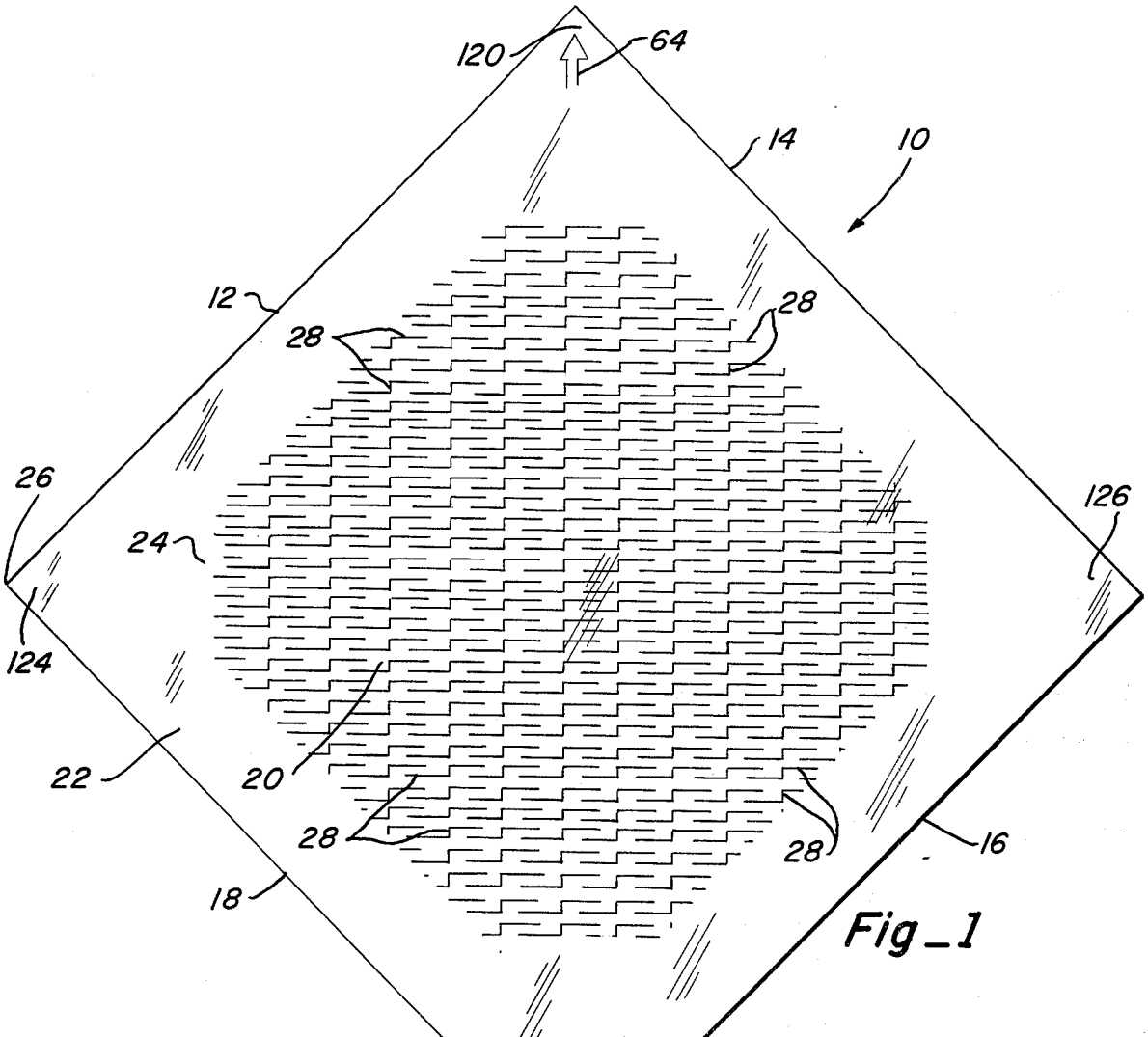
FIG. 1 is a bottom plan view showing a wrapper of plastic sheet material having an unexpanded slit pattern of the present invention in the center thereof.

Referring now to FIG. 1, the wrapper of the present invention is shown to comprise a sheet 10 of relatively thin transparent plastic material having a square periphery defined by equal length edge portions 12, 14, 16, 18. In the presently preferred embodiment of the invention, the plastic material is a polyethylene film of 1.75 mil thickness with the length of the edge portions being 12 inches. A center portion 20 of the sheet is provided with an expandable slit pattern located within a solid margin portion 22 of approximately 1½ inch width. The portions 24 of the slit pattern adjacent the corners 26 of the sheet terminate inwardly of the corners a distance of approximately 2½ inches and extend at 45° relative to the adjacent edge portions a distance of approximately 1¼ inches.

The slits 28 of the slit pattern are identical in length and configuration except at the outer edges of the slit pattern next adjacent the solid margin portion where only portions of the adjacent slits may be provided. Each of the slits 28 comprises a pair of parallel laterally offset elongated slit portions 30, 32 with adjacent ends interconnected by a transversely extending relatively short slit portion 34. For purposes of description, the longitudinal direction of the elongated slit portions 30, 32 is hereinafter referred to as the longitudinal direction of the slit pattern and the transverse direction of the slit portion 34 is hereinafter referred to as the transverse direction of the slit pattern.

Figure 2:
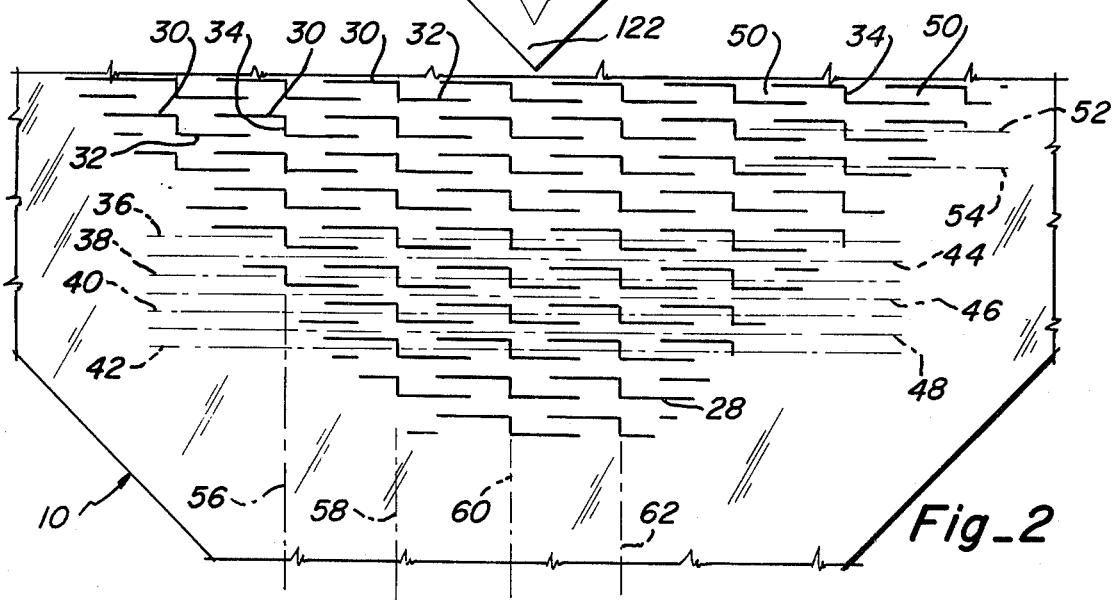
FIG. 2 is an enlarged fragmentary top plan view of the wrapper of FIG. 1 showing the slit pattern in an unexpanded condition.

Referring to FIG. 2, it may be seen that there are a plurality of parallel rows of slits 36, 38, 40, 42, for example, extending in the longitudinal direction of the slit pattern and equally spaced from one another in the transverse direction of the slit pattern. Within each of the parallel longitudinal rows of slits, are a plurality of individual slits 28 which are longitudinally aligned with adjacent slits equally spaced relative to one another. The elongated longitudinal slit portions 30, 32 of each slit in each row are parallel and aligned with the corresponding slit portions 30, 32 of the other slits in each row. The slit portions 34 of each slit in each row are parallel and longitudinally aligned with the corresponding slit portions 34 of the other slits in each row. Slit portions 30, 32 of each slit in each row are located in transverse offset relationship and overlap portions of slit portions 30, 32 of each adjacent slit with slit portion 30 of one slit being transversely offset and overlapping slit portion 32 of one next adjacent slit and slit portion 32 of the one slit being transversely offset and overlapping slit portion 30 of the other next adjacent slit. Thus, the slits 28 define a plurality of transversely spaced rows of solid continuously longitudinally extending ribbon portions 44, 46, 48, for example, of sheet material which are interconnected by longitudinally spaced ribbon portions 50 separated by transverse slit portions 34 and arranged in a plurality of transversely spaced longitudinally extending rows 52, 54, for example, located between the rows of solid ribbon portions. It may be noted that there are also a plurality of parallel rows of slits 56, 58, 60, 62, for example, extending in the transverse direction of the slit pattern and equally spaced from one another in the longitudinal direction of the slit pattern. Again, each of the slits 28 in each of the transverse rows of slits are aligned with one another with the various slit portions of each slit being parallel to the corresponding slit portions of the other slits in each row. Thus, the present invention may be distinguished from prior art slit patterns in which the slits of adjacent rows are offset from one another rather than being parallel and equally spaced from one another as in the present invention.

In the presently preferred embodiment the length of each slit 28 is approximately 1⅛ inches, the length of the slit portions 30, 32 being 9/16 inch and the length of slit portion 34 being ⅛ inch. The longitudinal distance between centers of the adjacent slits in each longitudinal row is approximately 13/16 inch as measured between the slit portions 34 of adjacent slits. The longitudinal distance between the transverse slit portion 34 of one slit and the end of the slit portions 30, 32 of adjacent slits is approximately ¼ inch. The transverse distance between adjacent longitudinal rows of slits is approximately 7/32 inch as measured between center lines 36, 38 from midpoint to midpoint of the transverse slit portions of transversely adjacent slits. The transverse distance between overlapping portions of the end portions 30, 32 of adjacent slits in each longitudinal row is approximately ⅛ inch which is also the width of the ribbon portions defined thereby.

Figure 3:
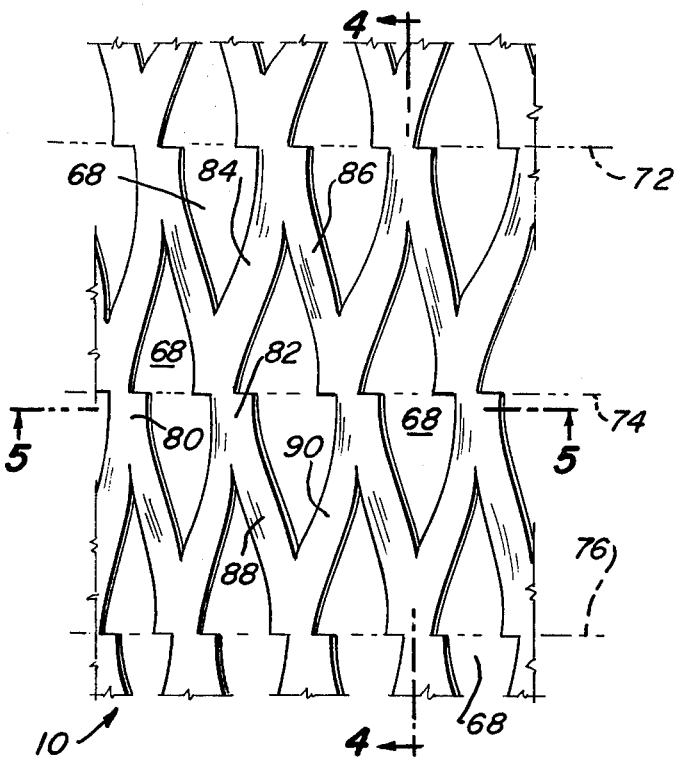
FIG. 3 is a still further enlarged fragmentary plan view showing a portion of the slit pattern of the wrapper of FIGS. 1 and 2 in a partially expanded condition.
Figure 4:
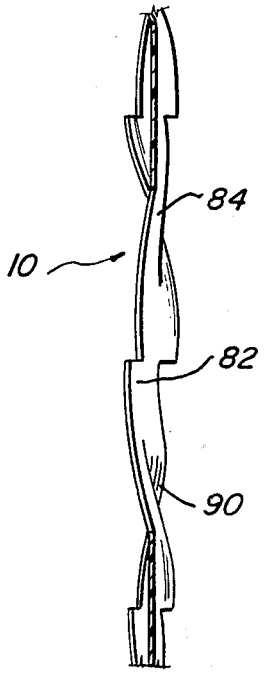
FIG. 4 is a section taken along line 4—4 of FIG. 3 to the same scale as the latter.
Figure 5:
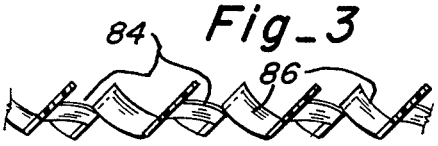
FIG. 5 is a section taken along line 5—5 of FIG. 3, once again to the same scale.
Figure 6:
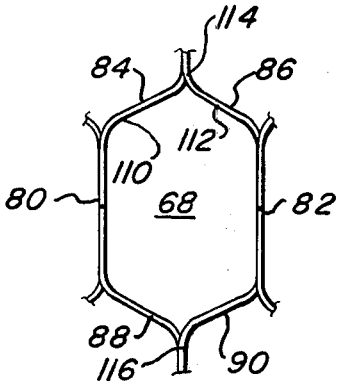
FIG. 6 is an enlarged plan view showing of a single opening of the slit pattern of the wrapper of FIGS. 1 and 2 in a further expanded condition than shown in FIG. 3.

The slit pattern provides for expansion of the center portion of the wrapper by application of opposing outwardly directed forces on opposite corners of the wrapper in a direction transverse to the longitudinal direction of the rows of slits as indicated by arrows 64, 66 in FIG. 1. As shown in FIGS. 3, 6–8, the expansion of the wrapper causes separation of the ribbon portions of the wrapper to form openings 68 of varying size and shape depending on the amount of force and the amount of expansion of the slit pattern. In general the openings are characterized by a honeycomb appearance, as shown in FIG. 3 comprising parallel transversely extending rows 72, 74, 76 of variably shaped openings 68 with the openings in alternate rows 72, 76 being transversely aligned relative to one another and with the openings in adjacent rows 72, 74; 74, 76; being in transversely staggered offset relationship to one another.

Each of the openings 68 are defined by interconnected continuous ribbon portions 80, 82, 84, 86, 88, 90 of the sheet material with opposite generally parallel spaced ribbon portions 80, 82 extending generally parallel to the longitudinal direction of the slit pattern and opposite spaced ribbon portions 84, 88 and 86, 90 extending generally transversely to the direction of the slit pattern.

A feature of the present invention is that when the slit pattern is expanded, the ribbon portions 80, 82, 84, 86, 88, 90 twist relative to the plane of the sheet of material so as to extend laterally from the surface of the contents wrapped therein rather than laying flat thereagainst.

Figure 8:
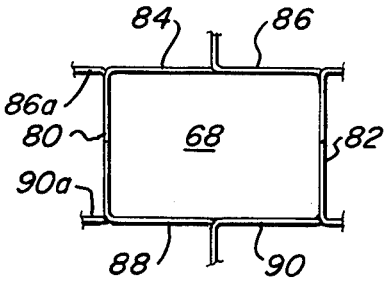
FIG. 8 is an enlarged plan view showing a single opening of the slit pattern of the wrapper of FIGS. 1 and 2 in a still further fully expanded condition than shown in FIG. 7.
Figure 9:
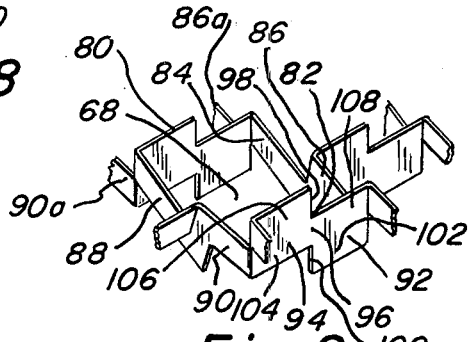
FIG. 9 is a partial perspective view of the slit portion of the wrapper of FIGS. 2 and 3 in the fully expanded condition of FIG. 8.

As best shown in FIG. 9, the ribbon portions 80, 82 each comprise substantially square interconnected segments 92, 94 interconnected at 96 along one half of the length of adjacent edges 98, 100 of the square segments. In the expanded condition, a portion 102 of one square segment 92 extends laterally in one direction beyond the adjacent portion 104 of the other square segment 94 and a portion 106 of the other square segment 94 extends laterally in the opposite direction beyond the corresponding portion 108 of the one square segment 92. The arrangement is such that the opposite transverse ribbon portions 84, 88 and 86, 90 are one half the width of the square segments and are laterally offset from one another a distance equal to their width so that in the expanded position none of the ribbon portions of any one opening are aligned relative to one another and all of the opposite pairs of ribbon portions are offset relative to one another. Maximum twist is induced in the ribbon portions 80, 82 in the fully expanded positions of FIGS. 7, 8 and 9 whereat the ribbon portions 80, 82 are twisted approximately 90° so that one portion 102 of the square portion 92 will extend laterally toward the contents of the wrapper while the other portion 106 of the other square portion 94 will extend laterally away from the contents in the opposite direction. The opposite ribbon portions 84, 86, 88, 90 will also be twisted, to a somewhat lesser extent than ribbon portions 80, 82 in the lesser expanded conditions of FIGS. 3 and 6, so as to extend at least in part generally laterally relative to the plane of the wrapper and the surface of the contents of the wrapper. In the twisted position, the ribbon portions become laterally extending vane means which serve to provide larger openings 68, to catch moisture applied to the contents of the wrapper through the openings, to cushion the contents of the wrapper relative to the wrapper and relative to externally applied forces as occur when the wrapper and its contents are handled, shipped, or stacked for display in a store, and to catch and reflect light to provide a unique glittering appearance. The large size openings are important because they enable thorough ventilation of the contents, thorough application of moisture to the contents, and facilitate the desire of purchasers of produce to see and touch the contents of the wrapper. The cushioning effect is also an advantage in that it provides a pleasing "fresh produce feel" when the wrapper and its contents are handled by a prospective purchaser. The twisting of the ribbon portions and, particularly the one of the portions 102, 106 of each of the square segments 92, 94 which extends laterally outwardly away from the wrapped article provides a multitude of small spaced resilient flexible easily displaced flap segments which easily give way under pressure resulting in a pleasing feel when handled, and provide multi-angled light reflecting surfaces resulting in a very unique pleasing appearance.

Figure 7:
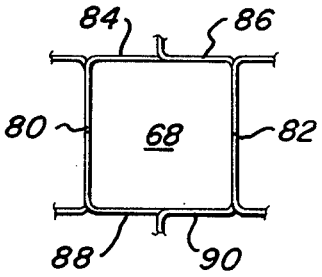
FIG. 7 is an enlarged plan view showing a single opening of the slit pattern of the wrapper of FIGS. 1 and 2 in a still further expanded condition than shown in FIG. 6.

The openings 68 provided in the slit pattern portion of the wrapper in the expanded position vary in size and shape as shown in FIGS. 3 and 6–8 which represent, respectively, a first partially expanded position, a second relatively fully expanded position, a third more fully expanded position, and a fourth maximum fully expanded position. In the first partially expanded position of FIG. 3, the openings 68 have an elongated somewhat oval shape with the ribbon portions 84, 86, 88, 90 having a generally concave curvature relative to the openings 68. In the second relatively full expanded position of FIG. 6, the openings 68 are somewhat lemon shape with the ribbon portions 80, 82 extending generally parallel to the longitudinal direction of the slit pattern. The ribbon portions 84, 86, 88, 90 are reversely curved with a first segment 110 next adjacent the ribbon portions 80, 82 curved concavely relative to the opening 68 and extending tangentially inwardly from the ribbon portions 80, 82. A second segment 112 of each of the ribbon portions 84, 86, 88, 90 is curved convexly relative to the opening 68 and the second segments of adjacent ribbon portions 84, 86, and 88, 90 intersect tangentially at 114, 116 to form oppositely extending peak portions at opposite ends of the opening. In the third more fully extended position of the slit pattern, the openings are substantially square shaped as shown in FIG. 7 with ribbon portions 80, 82 forming opposed generally parallel side wall portions of the opening and with ribbon portions 84, 86 and 88, 90 forming opposed generally parallel side wall portions of the opening 68. In the fourth substantially fully extended position of the slit pattern, the openings 68 are substantially rectangular shaped as shown in FIG. 8 with ribbon portions 80, 82 forming opposed generally parallel side wall portions of the opening of equal length and with ribbon portions 84, 86 and 88, 90 forming opposed generally parallel side wall portions of the opening of equal greater length than the length of ribbon portions 80, 82. The differences in shape of the openings is due to the amount of forces applied transverse to the direction of the slit pattern and the amount of stretching of the ribbon portions 84, 86 and 88, 90 in response to such forces.

In use of the wrapper hereinbefore described, the contents to be wrapped are placed over the central slitted portion 20 and the slit pattern is expanded by pulling on the opposite corners 120, 122 of the wrapper in the direction of the arrows 64, 66, FIG. 1. The corners of the wrapper 120, 122 and 124, 126 are brought over and around the contents into juxtaposition opposite the center of the slitted portion 20 whereat the corners may be secured in any suitable manner as by tying or heat sealing or by use of a fastening device such as a rubber band or wire tie.

While a presently preferred embodiment of the invention concepts has been shown and described herein, it is to be understood that the inventive concepts may be variously otherwise embodied in alternative embodiments of the invention. For example, other materials and other packaging devices such as bags, boxes, and covers may incorporate certain of the inventive concepts. In addition, the location, size, shape and orientation of the slit pattern relative to the wrapper may be varied as necessary or desirable. Consequently, it is intended that the claims to the invention hereinbefore described be construed to include alternative embodiments of the inventive concepts except insofar as limited by the prior art.

The invention claimed is:

1. A wrapper for produce and the like which comprises:

a sheet of thin pliable plastic material having the central area thereof cut to define a plurality of generally step-shaped slits, each of said slits including parallel end portions arranged in laterally offset staggered relation to one another and a transversely extending midsection interconnecting the adjacent ends of said end portions in transverse relationship thereto, adjacent ones of said slits being longitudinally and transversely aligned to define longitudinally and transversely extending rows, and the end portions of adjacent slits in each longitudinally extending row overlapping one another in end-to-end relation.

2. The invention as defined in claim 1 and wherein said wrapper being adapted to be expanded to provide a plurality of openings therein by oppositely directed forces and further comprising:

the slits in each row of said slits being uniformly equally spaced from adjacent slits in said rows and each row of slits being uniformly equally spaced from adjacent rows of slits;

said end portions of said slits extending generally transversely to the direction of application of the oppositely directed forces and said midsection of said slits extending generally parallel to the direction of application of the oppositely directed forces; and said end portions of said slits having a length substantially longer than the length of said midsections of said slits whereby the oppositely directed forces are applied generally transversely to a majoral portion of each slit including said end portions of said slits to provide openings in said wrapper.

3. The invention as defined in claim 2 and wherein:

said openings being defined by a pair of opposite spaced ribbon portions extending parallel to said slits and opposite spaced pairs of ribbon portions extending transversely of said slits.

4. The invention as defined in claim 3 and wherein:

said opposite spaced pairs of ribbon portions extending transversely of said slits are laterally offset from one another.

5. The invention as defined in claim 4 and wherein:

said pair of opposite spaced ribbon portions extending parallel to said slits each comprise a pair of laterally offset portions.

6. The invention as defined in claim 5 and wherein:

at least some portions of said ribbon portions being twisted and extending laterally relative to the plane of said sheet of material in the expanded position.

7. The invention as defined in claim 6 and wherein:

said pair of laterally offset portions include resilient deflectable flap segments.

8. The invention as defined in claim 6 and wherein:

said openings have a generally elliptical shape.

9. The invention as defined in claim 6 and wherein:

said openings have a generally polygonal shape.

* * * * *